US009030100B2

(12) United States Patent
Aoyama et al.

(10) Patent No.: US 9,030,100 B2
(45) Date of Patent: May 12, 2015

(54) CATHODE COMPONENT FOR DISCHARGE LAMP

(71) Applicants: Kabushiki Kaisha Toshiba, Tokyo (JP); Toshiba Materials Co., Ltd., Yokohama-Shi (JP)

(72) Inventors: Hitoshi Aoyama, Tokyo (JP); Masahiro Tatesawa, Tokyo (JP); Noboru Kitamori, Tokyo (JP)

(73) Assignees: Kabushiki Kaisha Toshiba, Minato-ku (JP); Toshiba Materials Co., Ltd., Yokohama-Shi (JP)

( * ) Notice: Subject to any disclaimer, the term of this patent is extended or adjusted under 35 U.S.C. 154(b) by 0 days.

(21) Appl. No.: 14/378,983

(22) PCT Filed: Feb. 13, 2013

(86) PCT No.: PCT/JP2013/053346

§ 371 (c)(1),
(2) Date: Aug. 15, 2014

(87) PCT Pub. No.: WO2013/122081

PCT Pub. Date: Aug. 22, 2013

(65) Prior Publication Data

US 2015/0028738 A1 Jan. 29, 2015

(30) Foreign Application Priority Data

Feb. 15, 2012 (JP) ..... 2012-030983

(51) Int. Cl.
*H01J 61/073* (2006.01)
*H01J 17/06* (2006.01)
*H01J 61/067* (2006.01)

(52) U.S. Cl.
CPC ..... *H01J 61/0677* (2013.01); *H01J 61/0737* (2013.01); *H01J 2893/0019* (2013.01)

(58) Field of Classification Search
None
See application file for complete search history.

(56) References Cited

U.S. PATENT DOCUMENTS 3,902,090 A * 8/1975 Ekkelboom et al. ..... 313/632
6,190,579 B1 * 2/2001 Billings ..... 252/515

(Continued)

FOREIGN PATENT DOCUMENTS

JP 2000-106131 A1 4/2000
JP 2001-342550 A1 12/2001

(Continued)

OTHER PUBLICATIONS

International Search Report (Application No. PCT/JP2013/053346) dated Apr. 2, 2013.

(Continued)

*Primary Examiner* — Ashok Patel
(74) *Attorney, Agent, or Firm* — Burr & Brown, PLLC

(57) ABSTRACT

A highly durable cathode component for a discharge lamp is provided. A cathode component for a discharge lamp includes a barrel having a wire diameter of 2 to 35 mm and a tapered front end, wherein the cathode component comprises a tungsten alloy containing 0.5 to 3% by weight, in terms of oxide ($ThO_2$), of a thorium component, not less than 90% of tungsten crystals are accounted for by tungsten crystals having a grain size in the range of 1 to 80 μm, as observed in terms of an area ratio of 300 μm×300 μm in unit area in a circumferential cross section of the barrel, and are accounted for by tungsten crystals having a grain size in the range of 10 to 120 μm, as observed in terms of an area ratio of 300 μm×300 μm in unit area in a side cross section of the barrel.

9 Claims, 3 Drawing Sheets

(56) References Cited

U.S. PATENT DOCUMENTS

| | | | | |
|---|---|---|---|---|
| 6,211,615 | B1 * | 4/2001 | Altmann et al. | 313/631 |
| 2003/0201719 | A1 * | 10/2003 | Ikeuchi et al. | 313/631 |
| 2006/0220559 | A1 | 10/2006 | Ikeuchi | |
| 2007/0103082 | A1 | 5/2007 | Fukuyo et al. | |
| 2012/0091922 | A1 | 4/2012 | Matsuo et al. | |

FOREIGN PATENT DOCUMENTS

| | | | |
|---|---|---|---|
| JP | 2002-226935 | A1 | 8/2002 |
| JP | 2003-132837 | A1 | 5/2003 |
| JP | 2005-015917 | A1 | 1/2005 |
| JP | 2005-183355 | A1 | 7/2005 |
| JP | 2006-066076 | A1 | 3/2006 |
| JP | 2006-286236 | A1 | 10/2006 |
| JP | 2007-134051 | A1 | 5/2007 |
| JP | 2012-099422 | A1 | 5/2012 |
| WO | 2011/049049 | A1 | 4/2011 |

OTHER PUBLICATIONS

International Preliminary Report on Patentability (Application No. PCT/JP2013/053346) dated Aug. 28, 2014.

* cited by examiner

CATHODE COMPONENT FOR DISCHARGE LAMP

TECHNICAL FIELD

The present invention relates to a cathode component for a discharge lamp.

BACKGROUND ART

Discharge lamps are classified roughly into low-pressure discharge lamps and high-pressure discharge lamps. Low-pressure discharge lamps include arc discharge-type discharge lamps, for example, general lightings, special lightings for use, for example, in roads and tunnels, coating material curing apparatuses, UV (ultraviolet) curing apparatuses, sterilizers, and light cleaning apparatuses, for example, for semiconductors. High-pressure discharge lamps include apparatuses for water supply and sewerage, general lightings, exterior lightings, for example, in stadiums, UV curing apparatuses, exposure devices, for example, for semiconductors and printed boards, wafer inspection apparatuses, high-pressure mercury lamps, for example, for projectors, metal halide lamps, ultrahigh-pressure mercury lamps, xenon lamps, and sodium lamps. Thus, discharge lamps are used for various apparatuses such as lighting apparatuses and production apparatuses.

Tungsten alloys containing thorium oxide ($ThO_2$) have hitherto been used in cathode components for discharge lamps. Japanese Patent Application Laid-Open No. 226935/2002 discloses a thorium-containing tungsten alloy that has been improved in resistance to deformation by finely dispersing thorium and a thorium compound in a mean grain size of not more than 0.3 μm.

PRIOR ART DOCUMENT

Patent Document

Patent document 1: Japanese Patent Application Laid-Open No. 226935/2002

SUMMARY OF THE INVENTION

Problems to be Solved by the Invention

In Japanese Patent Application Laid-Open No. 226935/2002, the resistance to deformation is examined with a coil having a diameter of 3 mm. It is certain that the coil formed of the thorium-containing tungsten alloy described in the above patent document has an improved resistance to deformation. On the other hand, the cathode component for a discharge lamp is a component to which a voltage of not less than 10 V, even hundreds of volts, is applied for exertion of emission characteristics. In the alloy obtained by finely dispersing thorium having a mean grain size of not more than 0.3 μm as proposed in Japanese Patent Application Laid-Open No. 226935/2002, the application of such a large voltage poses a problem of a short service life of the discharge lamp due to immediate evaporation of thorium.

Further, homogeneously dispersing fine thorium having a mean grain size of not more than 0.3 μm suffers from a large burden in the production process. Heterogeneous dispersion of thorium leads to uneven emission sites within the cathode component, and the prolongation of the service life is difficult also from this viewpoint.

The present invention has been made with a view to solving the problems, and an object of the present invention is to provide a cathode component that can realize a long service life, for example, in discharge lamps to which a high voltage of not less than 10 V is applied.

Means for Solving the Problems

According to the present invention, there is provided a cathode component for a discharge lamp, the cathode component comprising: a barrel having a wire diameter of 2 to 35 mm; and a tapered front end, wherein the cathode component comprises a tungsten alloy containing 0.5 to 3% by weight, in terms of oxide ($ThO_2$), of a thorium component, not less than 90% of tungsten crystals are accounted for by tungsten crystals having a grain size in the range of 1 to 80 μm, as observed in terms of an area ratio of 300 μm×300 μm in unit area in a circumferential cross section of the barrel, and not less than 90% of tungsten crystals are accounted for by tungsten crystals having a grain size in the range of 10 to 120 μm, as observed in terms of an area ratio of 300 μm×300 μm in unit area in a side cross section of the barrel.

In an embodiment of the present invention, preferably, not less than 90% of thorium component grains are accounted for by thorium component grains having a size in the range of 1 to 15 μm, as observed in terms of an area ratio of 300 μm×300 μm in unit area in a circumferential cross section of the barrel, and not less than 90% of thorium component grains are accounted for by thorium component grains having a size in the range of 1 to 30 μm, as observed in terms of an area ratio of 300 μm×300 μm in unit area in a side cross section of the barrel.

In an embodiment of the present invention, preferably, the tungsten crystals have an aspect ratio of less than 3 in a circumferential cross section and not less than 3 in a side cross section.

In an embodiment of the present invention, preferably, the cathode component has a Mo (molybdenum) content of not more than 0.005% by weight.

In an embodiment of the present invention, preferably, the cathode component has an Fe (iron) content of not more than 0.003% by weight.

In an embodiment of the present invention, preferably, the cathode component has a specific gravity in the range of 17 to 19 g/cm$^3$.

In an embodiment of the present invention, preferably, the cathode component has a hardness (HRA) in the range of 55 to 80.

In an embodiment of the present invention, preferably, the cathode component has a surface roughness Ra of not more than 5 μm.

In an embodiment of the present invention, the cathode component can also be used in a discharge lamp to which a voltage of not less than 100 V is applied.

Effect of the Invention

According to the present invention, cathode components for discharge lamps that have excellent emission characteristics and high-temperature strength can be realized by regulating tungsten grain sizes in both a cross-sectional direction and a side cross section of the barrel. Accordingly, discharge lamps using the cathode components can realize a prolonged service life.

EMBODIMENTS FOR CARRYING OUT THE INVENTION

Figure 1:
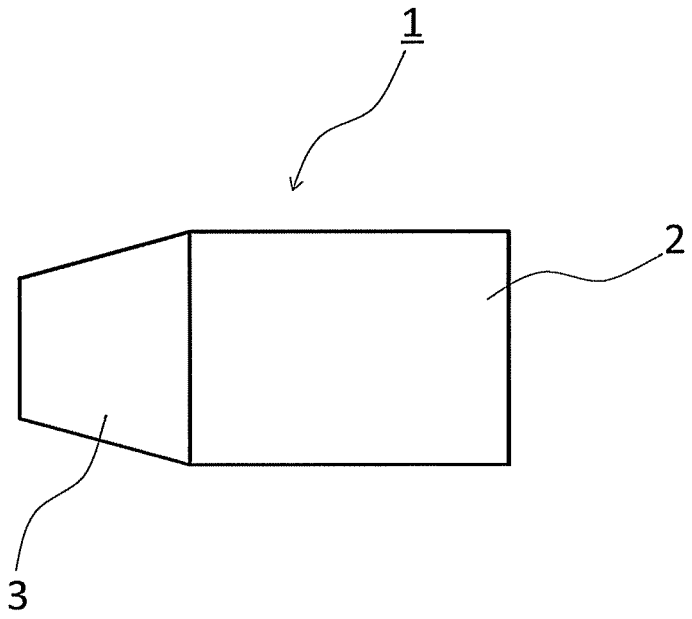
FIG. 1 is a view showing one example of a cathode component of the present invention.

The cathode component for a discharge lamp according to the present invention comprises: a barrel having a wire diameter of 2 to 35 mm; and a tapered front end, wherein the cathode component comprises a tungsten alloy containing 0.5 to 3% by weight, in terms of oxide ($ThO_2$), of a thorium component. Further, in the present invention, not less than 90% of tungsten crystals are accounted for by tungsten crystals having a grain size in the range of 1 to 80 μm, as observed in terms of an area ratio of 300 μm×300 μm in unit area in a circumferential cross section of the barrel, and not less than 90% of tungsten crystals are accounted for by tungsten crystals having a grain size in the range of 10 to 120 μm, as observed in terms of an area ratio of 300 μm×300 μm in unit area in a side cross section of the barrel.

At the outset, the thorium component is one of or both metallic thorium and thorium oxide. The cathode component for a discharge lamp according to the present invention contains 0.5 to 3% by weight of the thorium component in terms of oxide ($ThO_2$). When the content of the thorium component is less than 0.5% by weight, the effect attained by the addition is small, while, when the content of the thorium component is more than 3% by weight, the sinterability and the workability are lowered. For this reason, the content of the thorium component is preferably in the range of 0.8 to 2.5% by weight in terms of oxide ($ThO_2$).

The cathode component comprises a barrel having a wire diameter of 2 to 35 mm and a tapered front end. FIGS. 1 to 4 show an example of a cathode component for a discharge lamp according to the present invention. In the drawings, numeral 1 designates a cathode component, numeral 2 a barrel, and numeral 3 a front end. The barrel 2 is cylindrical and has a diameter of 2 to 35 mm. Preferably, the barrel 2 has a length of 10 to 600 mm. As described above, discharge lamps are used in various fields of applications, and brightness required is also varied. Accordingly, the thickness (diameter) of the barrel in the cathode component is varied according to the brightness required. Further, the length of the barrel is also varied according to the size of the discharge lamp.

Figure 4:
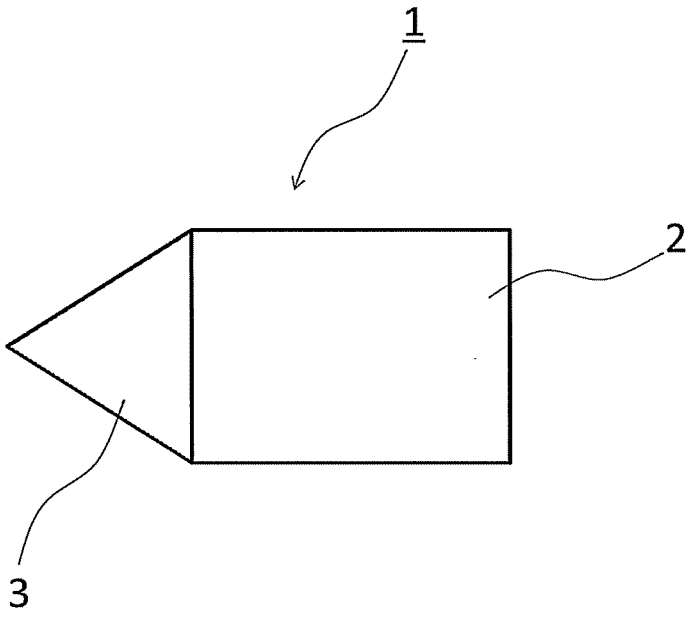
FIG. 4 is a view showing one example of a cathode component according to the present invention.
Figure 5:
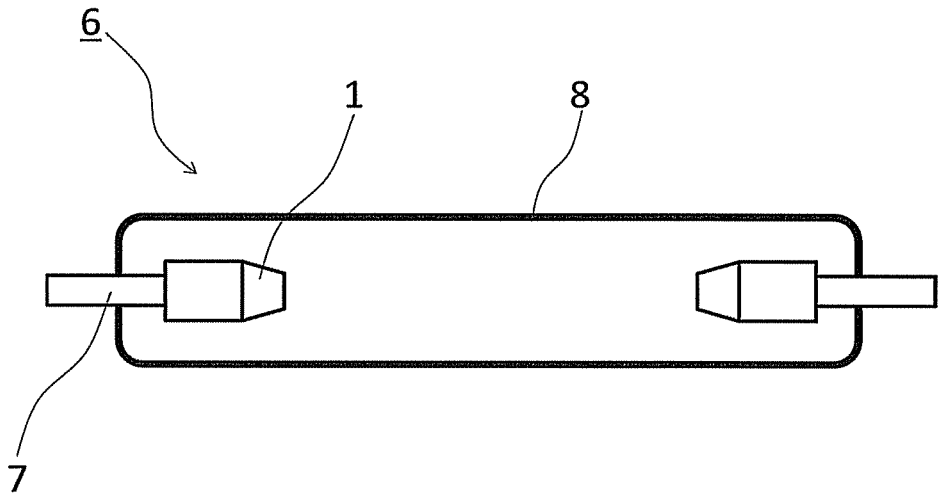
FIG. 5 is a view showing one example of a discharge lamps of the present invention.

The front end 3 is, for example, in the form of a trapezoid in section as shown in FIG. 1 and in the form of a triangle in section as shown in FIG. 4. The triangle in section is not necessarily required to be an acute-angled front end and may be in an R form. Further, in the present invention, the shape of the front end is not limited to the above 2 types, and any shape may be possible as long as the shape is usable as the cathode component for discharge lamps. The front end of the cathode component should be tapered. In the discharge lamp, a pair of cathode components are incorporated with the cathode components facing each other. When the front end has a tapered shape, the efficiency of discharge between the pair of components can be enhanced.

Figure 2:
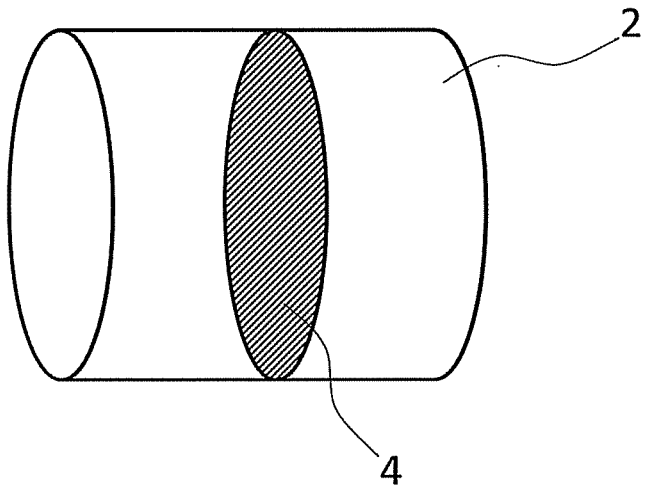
FIG. 2 is a view showing one example of a circumferential cross section.
Figure 3:
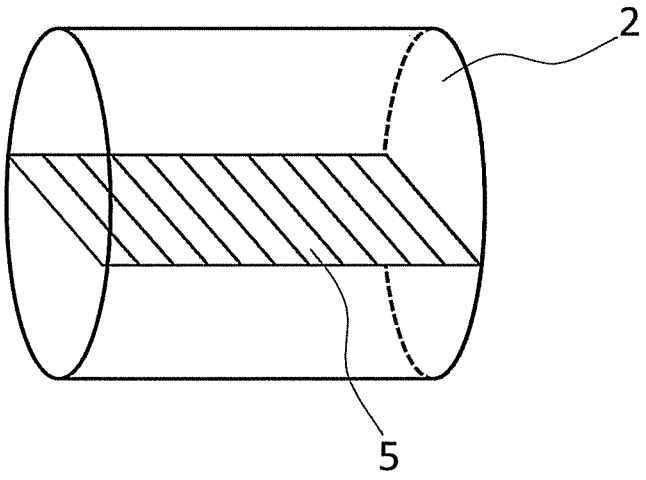
FIG. 3 is a view showing one example of a side cross section.

In the present invention, the following requirement should be satisfied: not less than 90% of tungsten crystals are accounted for by tungsten crystals having a grain size in the range of 1 to 80 μm, as observed in terms of an area ratio of 300 μm×300 μm in unit area in a circumferential cross section of the barrel, and not less than 90% of tungsten crystals are accounted for by tungsten crystals having a grain size in the range of 10 to 120 μm, as observed in terms of an area ratio of 300 μm×300 μm in unit area in a side cross section of the barrel. FIG. 2 shows an example of the cross section of a circumferential direction of the barrel, and FIG. 3 shows an example of the cross section of a side direction of the barrel. As shown in FIG. 2, the circumferential cross section is a cross section perpendicular to the side face. When the cross section is perpendicular to the side face, any place may be used for the cross section but, preferably, the measurement is carried out in a central cross section of the length of the barrel. The side cross section is a cross section parallel to the side face. When the cross section is parallel to the side face, any place may be used for the cross section. Preferably, however, a central cross section of the length of the barrel is a circumferential cross section, and a side cross section is a cross section perpendicular to the middle point.

In the present invention, not less than 90% of tungsten crystals are accounted for by tungsten crystals having a grain size in the range of 1 to 80 μm, as observed in terms of an area ratio of 300 μm×300 μm in unit area in a circumferential cross section of the barrel. The expression "not less than 90% in area ratio of tungsten crystals are accounted for by tungsten crystals having a grain size in the range of 1 to 80 μm" means that less than 10% in area ratio of tungsten grains are accounted for by tungsten grains having a size of less than 1 μm and tungsten grains having a size of more than 80 μm. That is, the proportion of fine crystals having a grain size of less than 1 μm and the proportion of coarse grains having a size of more than 80 μm are small. In the circumferential direction of the barrel, the proportion of tungsten crystals having a grain size of 1 to 80 μm is preferably 100% in area ratio.

In the present invention, not less than 90% of tungsten crystals are accounted for by tungsten crystals having a grain size in the range of 10 to 120 μm, as observed in terms of an area ratio of 300 μm×300 μm in unit area in a side cross section of the barrel. The expression "not less than 90% in area ratio of tungsten crystals are accounted for by tungsten crystals having a grain size in the range of 10 to 120 μm" means that less than 10% in area ratio of tungsten grains are accounted for by tungsten grains having a size of less than 10 μm and tungsten grains having a size of more than 120 μm in a unit area of 300 μm×300 μm. In the side cross section of the barrel, the proportion of tungsten crystals having a size of 10 to 120 μm is preferably 100% in area ratio.

The size of tungsten grains affects the strength of cathode components and emission characteristics. The thorium component that is an emitter material is dispersed at grain boundaries among tungsten crystals themselves. When the size of tungsten crystals is in the above-defined range, the homogeneity of grain boundaries among tungsten crystals in which the thorium component is dispersed can be three-dimensionally regulated. That is, the grain boundaries among tungsten crystals can be allowed to three-dimensionally homogeneously exist by the regulation of both a circumferential cross section and a side cross section of the barrel rather than mere regulation of a unidirectional sectional structure. As a result, the thorium component can be homogeneously dispersed. Further, from the viewpoint of homogeneous dispersion, preferably, not less than 90% of tungsten crystals are accounted for by tungsten crystals having a grain size in the range of 2 to 30 μm, as observed in terms of an area ratio of 300 μm×300 μm in unit area in a circumferential cross section of the barrel, and not less than 90% of tungsten crystals are accounted for by tungsten crystals having a grain size in the range of 15 to 50 μm, as observed in terms of an area ratio of 300 μm×300 μm in unit area in a side cross section of the barrel.

Preferably, not less than 90% of thorium component grains contained in the barrel are accounted for by thorium component grains having a size in the range of 1 to 15 μm, as observed in terms of an area ratio of 300 μm×300 μm in unit area in a circumferential cross section of the barrel, and not less than 90% of thorium component grains are accounted for by thorium component grains having a size in the range of 1 to 30 μm, as observed in terms of an area ratio of 300 μm×300 μm in unit area in a side cross section of the barrel. The size of thorium component grains can be measured using the same cross-sectional photograph as used in the observation of tungsten grains. The thorium component is metallic thorium or thorium oxide ($ThO_2$). The size of thorium component grains is determined by providing an enlarged photograph and determining the maximum Feret size of thorium component grains photographed thereon. When the size of thorium component grains is in the above-defined range, the thorium component grains are likely to be homogeneously dispersed at grain boundaries of tungsten crystals. When the thorium component grains are homogeneously dispersed at a predetermined size, the emission characteristics are improved. Further, the evaporation of the thorium component grains by emission is homogenized, leading to the prolongation of the service life of cathode components. When the prolongation of the service life of cathode components can be realized, the prolongation of the service life of discharge lamps can be realized. In particular, since emission characteristics are improved, the service life can be prolonged while maintaining the brightness of discharge lamps. Preferably, 100% of thorium component grains are accounted for by thorium component grains having a size of 1 to 15 μm as observed in a circumferential cross section of the barrel, and 100% of thorium component grains are accounted for by thorium component grains having a size of 1 to 30 μm as observed in a side cross section of the barrel.

Further, preferably, the tungsten crystals have an aspect ratio of less than 3 in a circumferential cross section and not less than 3 in a side cross section. When the aspect ratio of tungsten crystals is less than 3 in a circumferential cross section, the structure of the tungsten crystals in a circumferential direction of the barrel is nearly elliptical or circular. When the aspect ratio of tungsten crystals in a side cross section is not less than 3, the structure of tungsten crystals in a side cross section of the barrel is in the form of elongated fibers. When fibrous crystals having an aspect ratio of 3 or more are in a bundle form (a sintered compact), the strength can be improved. Further, it is considered from the viewpoint of improving the strength that the aspect ratio of tungsten crystals in a circumferential cross section is brought to 3 or more, that is, a fibrous structure is adopted. When the aspect ratio is 3 or more in both the circumferential cross section and the side cross section, the strength is increased but, on the other hand, the workability is lowered. When the fibrous crystals are randomly aligned, wire breaking is likely to occur due to contact with a die in wire drawing. When tungsten crystals are fibrous only in the side cross section, contact with the die is smooth and, consequently, wire breaking in wire drawing can be suppressed. Further, when fibrous crystals are randomly aligned, the angle of contact of a grinding stone with tungsten crystals is random when the front end is tapered, leading to a variation in workable amount. When a variation in workable amount occurs, a lot of time is taken for homogeneous working of the front end. When the angle of contact with the grinding stone is random, the consumption of the grinding stone is fast, which is causative of an increase in cost.

The cathode component according to the present invention may contain at least one of K (potassium), Al (aluminum), and Si (silicon) in an amount of 0.001 to 0.01% by weight. K, Al, and Si function as a doping material, and the addition of these materials is effective in regulating a recrystallized structure.

Further, in the cathode component according to the present invention, the content of Mo and the content of Fe are preferably not more than 0.005% by weight and not more than 0.003% by weight, respectively. The tungsten alloy of the present invention may contain not more than 0.1% (including 0%) by weight in total of impurity metal components. Among impurity metal components, Mo (molybdenum) and Fe (iron) are components that are likely to be mixed in starting materials or during the production process. When the content of Mo is more than 0.005% by weight (50 ppm by weight) or when the content of Fe is more than 0.003% by weight (30 ppm by weight), the high-temperature strength of the tungsten alloy is likely to be lowered. Impurities other than Mo and Fe include Ni (nickel), Cr (chromium), Cu (copper), Ca (calcium), Mg (magnesium), and C (carbon). The contents of Ni (nickel), Cr (chromium), Cu (copper), Ca (calcium), Mg (magnesium), Na (sodium), and C (carbon) are preferably not more than 10 ppm by weight, not more than 10 ppm by weight, not more than 10 ppm by weight, not more than 10 ppm by weight, not more than 10 ppm by weight, not more than 10 ppm by weight, and not more than 10 ppm by weight, respectively. The contents of the impurity components are preferably each 0% (limit of detection or less).

The components are determined by the following analytical method. The thorium component is determined by a hydrogen chloride gas volatile component separation-gravimetric analysis. K and Na are determined by an acid decomposition-atomic absorption analysis. Al, Si, Fe, Ni, Cr, Mo, Cu, Ca, and Mg are determined by an acid decomposition-ICP emission spectroscopic analysis. C is determined by a high-frequency induction heating oven combustion-infrared-absorbing analysis.

The cathode component according to the present invention preferably has a specific gravity in the range of 17 to 19 g/cm$^3$. When the specific gravity is less than 17 g/cm$^3$, the component is in a low density and porous state and consequently sometimes has a lowered strength. On the other hand, when the specific gravity is more than 19 g/cm$^3$, the effect is sometimes saturated.

Preferably, the cathode component according to the present invention has a hardness (HRA) in the range of 55 to 80. When the hardness is less than 55, the strength is unsatisfactory as the component and the service life is likely to be shortened. On the other hand, when the hardness is more than 80, the workability is likely to be lowered due to the excessive hardness. The hardness (HRA) is preferably in the range of 60 to 70. The hardness (HRA) can be effectively regulated by regulating the tungsten crystal size and the specific gravity. The measurement of the hardness (HRA) is carried out with a 120-degree diamond conical indenter under a test load of 60 kg.

Further, the cathode component according to the present invention preferably has a surface roughness Ra of not more than 5 μm. In particular, the surface roughness Ra in the front end is preferably not more than 5 μm, more preferably not more than 3 μm. When the surface irregularities are large, emission characteristics are lowered.

The above cathode components for discharge lamps can be applied to various discharge lamps. Thus, a prolonged service life can be realized even when a large voltage of not less than 100 V is applied. The use of the cathode components is not restricted, and the cathode components may be used, for example, in the above low-pressure discharge lamps and high-pressure discharge lamps. Further, the barrel may have a wire diameter of 2 to 35 mm. That is, a wide range of wire diameters, that is, a small wire diameter of 2 mm (inclusive) to 10 mm (exclusive) and a large wire diameter of 10 mm to 35 mm, can be applied.

Next, a method for manufacturing a cathode component according to the present invention will be described. The cathode component according to the present invention is not particularly limited as long as the cathode component has the above construction. However, the following manufacturing method may be mentioned as a method that can efficiently manufacture the cathode component.

In the preparation of a tungsten alloy, at the outset, a tungsten alloy powder containing a thorium component is prepared. A wet process and a dry process may be used for the preparation of the tungsten alloy powder.

In the wet process, at the outset, the step of preparing a tungsten component powder is carried out. An ammonium tungstate (APT) powder, a metallic tungsten powder, and a tungsten oxide powder may be mentioned as the tungsten component powder. One of or two or more of them may be used as the tungsten component powder. The ammonium tungstate powder is preferred from the viewpoint of a relatively low price. The tungsten component powder preferably has a mean grain size of not more than 5 μm.

When the ammonium tungstate powder is used, the ammonium tungstate powder is heated in the atmosphere or in an inert atmosphere (for example, nitrogen or argon) to 400 to 600° C. to convert the ammonium tungstate powder to a tungsten oxide powder. When the temperature is below 400° C., conversion to the tungsten oxide is unsatisfactory. On the other hand, when the temperature is above 600° C., tungsten oxide grains are coarse, making it difficult to homogeneously disperse the tungsten oxide in the thorium oxide powder in a later step. In this step, the tungsten oxide powder is prepared.

Next, the step of adding the thorium component powder and the tungsten oxide powder to a solution is carried out. A metallic thorium component powder, a thorium oxide powder, and a thorium nitrate powder may be mentioned as the thorium component powder. Among them, the thorium nitrate powder is preferred. The thorium nitrate powder is a component that can easily be homogeneously mixed in a liquid. In this step, a solution containing the thorium component and the tungsten oxide powder is prepared. Preferably, addition is carried out so that the same concentration as a finally contemplated thorium oxide concentration or a concentration slightly higher than the finally contemplated thorium oxide concentration is provided. The thorium component powder preferably has a mean grain size of not more than 5 μm. Further, the solution is preferably pure water.

Next, the step of evaporating a liquid component in the solution containing the thorium component and the tungsten oxide powder is carried out. Subsequently, the step of decomposition is carried out in which the solution is heated in the atmosphere at 400 to 900° C. to convert the thorium component such as thorium nitrate to thorium oxide. In this step, a mixed powder composed of the thorium oxide powder and the tungsten oxide powder can be prepared. Preferably, the concentration of thorium oxide in the resultant mixed powder composed of the thorium oxide powder and the tungsten oxide powder is measured, and the tungsten oxide powder is added when the concentration is low.

Next, the mixed powder composed of the thorium oxide powder and the tungsten oxide powder is heated at 750 to 950° C. in a reducing atmosphere such as hydrogen to reduce the tungsten oxide powder to a metallic tungsten powder. In this step, a tungsten powder containing a thorium oxide powder can be prepared.

In the dry process, a thorium oxide powder is first provided. The step of grinding and mixing the thorium oxide powder in a ball mill is then carried out. In this step, the aggregated thorium oxide powder can be loosened, making it possible to reduce the aggregated thorium oxide powder. In the step of mixing, a small amount of a metallic tungsten powder may be added.

Preferably, the ground and mixed thorium oxide powder is if necessary sieved to remove an aggregated powder or coarse grains that could not have been satisfactorily ground. Preferably, an aggregated powder or coarse grains having a maximum size of more than 10 μm is removed by sieving.

The step of mixing the metallic tungsten powder is then carried out. The metallic tungsten powder is added so that a finally contemplated thorium oxide concentration is provided. The mixed powder composed of the thorium oxide powder and the metallic tungsten powder is placed in a mixing vessel, and the mixing vessel is rotated for homogeneous mixing. When the mixing vessel is cylindrical, mixing can be smoothly achieved by rotation in a circumferential direction. In this step, a tungsten powder containing a thorium oxide powder can be prepared.

Thus, a tungsten powder containing a thorium oxide powder can be prepared by a wet process or a dry process. The wet process is more preferred than the dry process. In the dry process, since mixing is carried out while rotating the mixing vessel, impurities are likely to be included due to friction between the starting powder and the vessel. The content of the thorium oxide powder is 0.5 to 3% by weight.

A molded product is prepared using the tungsten powder containing the thorium oxide powder. In the formation of the molded product, if necessary, a binder may be used. The molded product is preferably in a cylindrical shape having a diameter of 3 to 50 mm. The molded product may have any desired length.

The step of presintering the molded product is then carried out. The temperature at which the presintering is carried out is preferably 1250 to 1500° C. In this step, a presintered compact can be obtained.

The step of energization sintering of the presintered compact is then carried out. In the energization sintering, energization is preferably carried out so that the temperature of the sintered compact is brought to 2100 to 2500° C. When the temperature is below 2100° C., the densification is unsatisfactory, sometimes leading to a lowered strength. On the other hand, when the temperature is above 2500° C., thorium oxide grains and tungsten grains are excessively grown and, consequently, a contemplated crystal structure cannot be sometimes obtained. In this step, a sintered compact of tungsten containing thorium oxide can be obtained. When the presintered compact is cylindrical, the sintered compact is also cylindrical.

The step of subjecting the cylindrical sintered compact (ingot) to forging, rolling, wire drawing or the like to regulate the wire diameter is then carried out. The reduction ratio in this case is preferably in the range of 30 to 70%. Here the "reduction ratio" is determined by the following equation. Reduction ratio=[(A−B)/A]×100% wherein A represents the sectional area of a cylindrical sintered compact before working; and B represents the sectional area of the cylindrical sintered compact after working. The wire diameter is preferably regulated by a plurality of times of working. Pores present in the cylindrical sintered compact before working can be collapsed by the plurality of times of working to obtain a cathode component having a high density.

For example, working will be described by taking, as an example, working of a cylindrical sintered compact having a diameter of 25 mm to a cylindrical sintered compact having a diameter of 20 mm. Since the sectional area A of a circle having a diameter of 25 mm and the sectional area B of a circle having a diameter of 20 mm are 460.6 $mm^2$ and 314 $mm^2$, respectively, the reduction ratio is 32%=[(460.6−314)/460.6]×100%. In this case, working from the diameter 25 mm to the diameter 20 mm is preferably carried out by a plurality of times of wire drawing.

When the reduction ratio is low and less than 30%, the crystal structure cannot be satisfactorily elongated in the direction of working, making it impossible to bring tungsten crystals and thorium component grains to a contemplated size. Further, when the reduction ratio is less than 30%, pores within the cylindrical sintered compact before working cannot be satisfactorily collapsed, leading to a possibility that the pores remain as they are. Remaining of internal pores is causative of a lowering in durability of the cathode component. On the other hand, when the reduction ratio is large and more than 70%, wire breaking occurs due to excessive working, possibly leading to a lowering in yield. For this reason, the reduction ratio is preferably 30 to 70%, more preferably 35 to 55%.

After working to a wire diameter of 2 to 35 mm, cutting to a necessary length provides a cathode component. If necessary, polishing, heat treatment, and shaping may be carried out.

The above manufacturing method can efficiently manufacture cathode components for discharge lamps according to the present invention.

EXAMPLES

Examples 1 to 5

An ammonium tungstate (APT) powder having a mean grain size of 3 μm was heated in the atmosphere to 500° C. to convert the ammonium tungstate powder to a tungsten oxide powder. Subsequently, a thorium nitrate powder having a mean grain size of 3 μm was added to the tungsten oxide powder, pure water was added, and the mixture was stirred for not less than 15 hr for homogeneous mixing. Water was then completely evaporated to obtain a homogeneously mixed powder composed of the thorium nitrate powder and the tungsten oxide powder. The powder was then heated in the atmosphere at 500° C. to convert the thorium nitrate powder to thorium oxide. The powder was then heat-treated in a hydrogen atmosphere (a reducing atmosphere) at 800° C. to reduce the tungsten oxide powder to a metallic tungsten powder. Thus, a mixed powder (a first starting material powder) composed of a thorium oxide powder and a metallic tungsten powder was prepared.

Separately, an ammonium tungstate (APT) powder having a mean grain size of 2 μm was heated to 450° C. in a nitrogen atmosphere to convert an ammonium tungstate powder to a tungsten oxide powder. Subsequently, the powder was heat-treated at 700° C. in a hydrogen atmosphere (a reducing atmosphere) to reduce the tungsten oxide powder to a metallic tungsten powder. Thus, a metallic tungsten powder (a second starting material powder) was prepared.

The second starting material powder was added to the first starting material powder to provide a tungsten powder having a thorium component content of 0.5% by weight in terms of thorium oxide ($ThO_2$) as Example 1. Likewise, a tungsten powder having a thorium component content of 1.0% by weight in terms of thorium oxide ($ThO_2$) was provided as Example 2, a tungsten powder having a thorium component content of 1.5% by weight in terms of thorium oxide ($ThO_2$) was provided as Example 3, a tungsten powder having a thorium component content of 2.0% by weight in terms of thorium oxide ($ThO_2$) was provided as Example 4, and a tungsten powder having a thorium component content of 2.5% by weight in terms of thorium oxide ($ThO_2$) was provided as Example 5.

Cylindrical sintered compacts (ingots) were prepared from the starting material powders (Examples 1 to 5) under conditions as specified in Table 1, followed by regulation of the wire diameter to obtain cathode components for discharge lamps that had respective predetermined reduction ratios. The wire diameter was regulated by a plurality of times of wire drawing. The wires were polished to a surface roughness Ra of not more than 5 μm.

TABLE 1

| | Presinter-ing temp. (° C.) | Electrical sintering temp. (° C.) | Cylindrical sintered compact (ingot) Diameter × length | Wire diameter of cathode component (mm) | Reduction ratio (%) |
|---|---|---|---|---|---|
| Example 1 | 1300 | 2200 | 5 mm in diameter × 50 mm | 3 mm in diameter | 64 |
| Example 2 | 1350 | 2250 | 10 mm in diameter × 100 mm | 8 mm in diameter | 36 |
| Example 3 | 1400 | 2300 | 20 mm in diameter × 100 mm | 16 mm in diameter | 36 |
| Example 4 | 1450 | 2300 | 26 mm in diameter × 100 mm | 20 mm in diameter | 41 |
| Example 5 | 1400 | 2350 | 35 mm in diameter × 100 mm | 25 mm in diameter | 49 |

Examples 6 to 10

A thorium oxide powder having a mean grain size of 3 μm was provided. The powder was ball-milled for 12 hr to reduce aggregates of the thorium oxide powder. The powder was then passed through a sieve having a mesh size of 10 μm to remove coarse grains having a size of not less than 10 μm. The thorium oxide powder was mixed with a metallic tungsten powder having a mean grain size of 3 μm, and the mixture was placed in a mixing vessel. The vessel was then rotated for 25 hr for mixing. Thus, a mixture having a thorium oxide ($ThO_2$) powder content of 0.5% by weight was provided as Example 6, a mixture having a thorium oxide ($ThO_2$) powder content of 1.0% by weight was provided as Example 7, a mixture having a thorium oxide ($ThO_2$) powder content of 1.5% by weight was provided as Example 8, a mixture having a thorium oxide ($ThO_2$) powder content of 2.0% by weight was provided as Example 9, and a mixture having a thorium oxide ($ThO_2$) powder content of 2.5% by weight was provided as Example10.

Cylindrical sintered compacts (ingots) were prepared from the starting material powders (Examples 6 to 10) under conditions as specified in Table 2, followed by regulation of the wire diameter to obtain cathode components for discharge lamps that had respective predetermined reduction ratios. The wire diameter was regulated by a plurality of times of wire drawing. The wires were polished to a surface roughness Ra of not more than 5 μm.

For the barrel in the cathode components of Examples 1 to 10 and Comparative Examples 1 and 2, the tungsten grain size and the aspect ratio, the diameter of thorium component grains, the impurity Mo (molybdenum) content and Fe (iron) content, the specific gravity, and the hardness (HRA) were examined.

The tungsten grain size and aspect ratio and the size of thorium component grains for the barrel were examined by taking off a circumferential cross section that passes through the center of the barrel, and a side cross section and examining the specimens for any unit area of 300 μm×300 μm. Further, the Mo content and the Fe content were determined by an ICP analysis. The specific gravity was measured by an Archimedes method. The hardness (HRA) was measured with a 120-degree diamond conical indenter under a test load of 60 kg. The results were as shown in Tables 4 and 5.

TABLE 2

| | Presinter-ing temp. (° C.) | Electrical sintering temp. (° C.) | Cylindrical sintered compact (ingot) Diameter × length | Wire diameter of cathode component (mm) | Reduction ratio (%) |
|---|---|---|---|---|---|
| Example 6 | 1300 | 2200 | 5 mm in diameter × 50 mm | 3 mm in diameter | 64 |
| Example 7 | 1350 | 2250 | 10 mm in diameter × 100 mm | 8 mm in diameter | 36 |
| Example 8 | 1400 | 2300 | 26 mm in diameter × 100 mm | 16 mm in diameter | 62 |
| Example 9 | 1450 | 2300 | 26 mm in diameter × 100 mm | 20 mm in diameter | 41 |
| Example 10 | 1400 | 2350 | 35 mm in diameter × 100 mm | 25 mm in diameter | 49 |

Comparative Examples 1 and 2

A thorium oxide powder having a mean grain size of 3 μm was provided. The powder was mixed with a metallic tungsten powder having a mean grain size of 3 μm without ball milling and sieving, the mixture was placed in a mixing vessel, and the vessel was rotated for 25 hr for mixing. The content of the thorium oxide powder ($ThO_2$) was 2.0% by weight.

Cylindrical sintered compacts (ingots) were prepared from the starting material powders under conditions specified in Table 3, followed by regulation of the wire diameter to obtain cathode components for discharge lamps that had respective predetermined reduction ratios. The wire diameter was regulated by a plurality of times of wire drawing. The wires were polished to a surface roughness Ra of not more than 5 μm.

TABLE 3

| | Presinter-ing temp. (° C.) | Electrical sintering temp. (° C.) | Cylindrical sintered compact (ingot) Diameter × length | Wire diameter of cathode component (mm) | Reduction ratio (%) |
|---|---|---|---|---|---|
| Comparative Example 1 | 1300 | 2250 | 10 mm in diameter × 50 mm | 3 mm in diameter | 91 |
| Comparative Example 2 | 1320 | 2220 | 9 mm in diameter × 100 mm | 8 mm in diameter | 21 |

TABLE 4

| | Thorium component content in % by weight (in terms of $ThO_2$) | Tungsten grain size: Circumferential cross section Proportion (%) of grains having size of 1 to 80 μm | Tungsten grain size: Side cross section Proportion (%) of grains having size of 10 to 120 μm | Thorium component grains: Circumferential cross section Proportion (%) of grains having size of 1 to 15 μm | Thorium component grains: Side cross section Proportion (%) of grains having size of 1 to 30 μm |
|---|---|---|---|---|---|
| Example 1 | 0.5 | 93 | 92 | 92 | 90 |
| Example 2 | 1.0 | 95 | 96 | 100 | 100 |
| Example 3 | 1.5 | 96 | 96 | 100 | 100 |
| Example 4 | 2.0 | 94 | 95 | 97 | 98 |
| Example 5 | 2.5 | 95 | 95 | 98 | 98 |
| Example 6 | 0.5 | 90 | 91 | 92 | 91 |
| Example 7 | 1.0 | 92 | 93 | 94 | 92 |
| Example 8 | 1.5 | 93 | 93 | 90 | 92 |
| Example 9 | 2.0 | 90 | 92 | 93 | 90 |
| Example 10 | 2.5 | 91 | 90 | 92 | 91 |
| Comparative Example 1 | 2.0 | 86 | 78 | 84 | 80 |
| Comparative Example 2 | 2.0 | 90 | 88 | 86 | 93 |

TABLE 5

| | Tungsten grain size: Circumferential cross section Mean aspect ratio | Tungsten grain size: Side cross section Mean aspect ratio | Mo content, % by weight | Fe content, % by weight | Specific gravity, g/cm$^3$ | Hardness (HRA) |
|---|---|---|---|---|---|---|
| Example 1 | 2.2 | 5.2 | 0.0015 | 0.0014 | 18.8 | 66 |
| Example 2 | 1.8 | 4.4 | 0.0014 | 0.0016 | 18.7 | 65 |
| Example 3 | 1.6 | 4.2 | 0.0017 | 0.0013 | 18.7 | 65 |
| Example 4 | 1.9 | 4.7 | 0.0015 | 0.0015 | 18.6 | 64 |
| Example 5 | 2.0 | 4.9 | 0.0018 | 0.0015 | 18.7 | 63 |
| Example 6 | 2.5 | 6.3 | 0.0030 | 0.0022 | 18.4 | 69 |
| Example 7 | 2.3 | 6.0 | 0.0032 | 0.0028 | 18.5 | 70 |
| Example 8 | 2.2 | 6.1 | 0.0027 | 0.0024 | 18.3 | 70 |
| Example 9 | 2.1 | 5.5 | 0.0025 | 0.0025 | 18.4 | 68 |
| Example 10 | 2.1 | 5.6 | 0.0024 | 0.0025 | 18.3 | 68 |
| Comparative Example 1 | 2.3 | 9.2 | 0.0045 | 0.0052 | 18.3 | 74 |
| Comparative Example 2 | 1.9 | 2.7 | 0.0045 | 0.0052 | 17.3 | 75 |

A durability test was carried out for the cathode components of Examples 1 to 10 and Comparative Examples 1 and 2. The durability test was carried out by energizing the cathode component, heating the cathode component to 2100 to 2200° C., and, in this state, applying a voltage of 100 V, 200 V, 300 V, and 400 V, and measuring an emission current density (mA/mm$^2$) at the elapse of 10 hr and an emission current density (mA/mm$^2$) at the elapse of 100 hr. The results were as shown in Table 6.

TABLE 6

| | Emission current density (mA/mm$^2$) 100 V 10 hr | 100 V 100 hr | 200 V 10 hr | 200 V 100 hr | 300 V 10 hr | 300 V 100 hr | 400 V 10 hr | 400 V 100 hr |
|---|---|---|---|---|---|---|---|---|
| Example 1 | 1.0 | 1.0 | 30.9 | 30.7 | 42.1 | 42.1 | 43.7 | 43.4 |
| Example 2 | 1.1 | 1.1 | 31.4 | 31.3 | 43.4 | 43.3 | 45.5 | 45.2 |
| Example 3 | 1.4 | 1.4 | 32.2 | 32.2 | 44.6 | 44.4 | 47.2 | 47.0 |
| Example 4 | 1.5 | 1.5 | 33.5 | 33.2 | 46.0 | 46.0 | 48.2 | 48.1 |
| Example 5 | 1.5 | 1.5 | 35.2 | 35.1 | 47.6 | 47.5 | 49.2 | 48.9 |

TABLE 6-continued

| | Emission current density (mA/mm$^2$) 100 V 10 hr | 100 V 100 hr | 200 V 10 hr | 200 V 100 hr | 300 V 10 hr | 300 V 100 hr | 400 V 10 hr | 400 V 100 hr |
|---|---|---|---|---|---|---|---|---|
| Example 6 | 1.0 | 1.0 | 30.8 | 30.5 | 41.8 | 41.7 | 43.5 | 43.0 |
| Example 7 | 1.1 | 1.1 | 31.2 | 31.0 | 43.1 | 43.0 | 45.4 | 45.1 |
| Example 8 | 1.3 | 1.3 | 32.2 | 32.1 | 44.4 | 44.2 | 46.8 | 46.5 |
| Example 9 | 1.5 | 1.5 | 33.3 | 33.0 | 45.8 | 45.4 | 47.9 | 47.3 |
| Example 10 | 1.5 | 1.5 | 35.0 | 34.7 | 47.4 | 47.2 | 48.8 | 48.2 |
| Comparative Example 1 | 1.4 | 1.2 | 32.0 | 28.4 | 45.5 | 40.6 | 47.0 | 42.1 |
| Comparative Example 2 | 1.4 | 1.2 | 32.0 | 29.6 | 45.5 | 41.3 | 47.0 | 42.5 |

As is also apparent from Table 6, it was found that the cathode components of Examples 1 to 10 were low in a lowering in emission current density at the elapse of 100 hr and had excellent durability. By contrast, the cathode components of Comparative Examples 1 and 2 exhibited about 10% lowering in durability. The reason for this is believed to reside, for example, in that the dispersed state of thorium component grains are heterogeneous due to a heterogeneous structure.

The durability when mixing was carried out in the wet process was better than that when mixing was carried out in the dry process. The reason for this is that, in the wet process, inclusion of impurities involved in mixing can be reduced.

As is apparent from the foregoing description, the cathode components according to the present invention are particularly useful for cathode components for discharge lamps to which a voltage of not less than 100 V is applied.

DESCRIPTION OF REFERENCE CHARACTERS

1 . . . cathode component
2 . . . barrel
3 . . . front end
4 . . . circumferential cross section
5 . . . side cross section
6 . . . discharge lamp
7 . . . support rod
8 . . . glass tube

The invention claimed is:

1. A cathode component for a discharge lamp, the cathode component comprising: a barrel having a wire diameter of 2 to 35 mm; and a tapered front end, wherein the cathode component comprises a tungsten alloy containing 0.5 to 3% by weight, in terms of oxide ($ThO_2$), of a thorium component, not less than 90% of tungsten crystals are accounted for by tungsten crystals having a grain size in the range of 1 to 80 μm, as observed in terms of an area ratio of 300 μm×300 μm in unit area in a circumferential cross section of the barrel, and not less than 90% of tungsten crystals are accounted for by tungsten crystals having a grain size in the range of 10 to 120 vim, as observed in terms of an area ratio of 300 μm×300 μm in unit area in a side cross section of the barrel.

2. The cathode component for a discharge lamp according to claim 1, wherein not less than 90% of thorium component grains are accounted for by thorium component grains having a size in the range of 1 to 15 μm, as observed in terms of an area ratio of 300 μm×300 μm in unit area in a circumferential cross section of the barrel, and not less than 90% of thorium component grains are accounted for by thorium component grains having a size in the range of 1 to 30 μm, as observed in terms of an area ratio of 300 μm×300 μm in unit area in a side cross section of the barrel.

3. The cathode component for a discharge lamp according to claim 1, wherein the tungsten crystals have an aspect ratio of less than 3 in a circumferential cross section and not less than 3 in a side cross section.

4. The cathode component for a discharge lamp according to claim 1, which has a Mo (molybdenum) content of not more than 0.005% by weight.

5. The cathode component for a discharge lamp according to claim 1, which has an Fe (iron) content of not more than 0.003% by weight.

6. The cathode component for a discharge lamp according to claim 1, which has a specific gravity in the range of 17 to 19 $g/cm^3$.

7. The cathode component for a discharge lamp according to claim 1, which has a hardness (HRA) in the range of 55 to 80.

8. The cathode component for a discharge lamp according to claim 1, which has a surface roughness Ra of not more than 5 μm.

9. The cathode component for a discharge lamp according to claim 1, for use in a discharge lamp to which a voltage of not less than 100 V is applied.

* * * * *